United States Patent [19]

Weissman

[11] Patent Number: 4,591,078

[45] Date of Patent: May 27, 1986

[54] DRIPLESS POURING CAP

[75] Inventor: Neal V. Weissman, New York, N.Y.

[73] Assignee: Colgate-Palmolive Company, New York, N.Y.

[21] Appl. No.: 566,915

[22] Filed: Dec. 29, 1983

[51] Int. Cl.[4] ..... B65D 25/48

[52] U.S. Cl. ..... 222/517; 222/571

[58] Field of Search ..... 222/571, 566–570, 222/543, 517; 215/306; 222/108, 109, 111

[56] References Cited

U.S. PATENT DOCUMENTS

| | | | |
|---|---|---|---|
| 2,601,039 | 6/1952 | Livingstone | 222/571 X |
| 3,199,750 | 8/1965 | Livingstone | 222/571 X |
| 3,307,752 | 3/1967 | Anderson | 222/569 X |
| 3,434,637 | 3/1969 | Marcel | 222/570 |
| 4,356,939 | 11/1982 | Fitte | 222/570 X |

*Primary Examiner*—Stanley H. Tollberg

*Attorney, Agent, or Firm*—Eric P. Schellin

[57] ABSTRACT

A dripless pouring cap having a funnel-shaped pouring spout with an outwardly curved pouring lip is screwed onto a container. Below the pouring lip are two catch basins to trap small amounts of liquid that has dripped from the pouring lip. A hinged lid is pivottally connected to the cap to facilitate opening and closing of the pouring spout. The catch basins and lid are so arranged so that opening and closing of the lid will not splash liquid trapped in the catch basins.

19 Claims, 4 Drawing Figures

DRIPLESS POURING CAP

BACKGROUND OF THE INVENTION

1. Field of the Invention

The invention relates to a dripless pouring cap having a pivotal closure means.

2. Description of the Prior Art

Presently many liquid products are stored in containers from which the product is doled out on an intermittent basis in relatively small portions by a consumer. A user of the product opens the container, pours the desired amount of product from the container and then reseals the container for later use. Consumers have found that this process can be messy when dispensing medium to high vicosity liquids, such as liquid detergents, vegetable oil, maple syrup, etc., because the product drips down the side of the container at the end of the pouring operation. The dripping results in a sticky liquid encrusted side which can be messy to store and handle.

To overcome this problem pouring spouts have been designed to prevent liquid from dripping from the pouring spout during the dispensing operation. One of the more common designs consists of modifying the pouring lip of the container so that it extends outwardly from the outside wall of the spout. During the end of the pouring operation this lip arrangement drains the last drop of the liquid stream back into the container preventing liquid from running down the sides of the container. Such drip preventing pouring lips are disclosed in U.S. Pat. Nos. 2,021,545, 3,136,458 and 3,341,046.

Although pouring spouts using outwardly directed pouring lips have in general, proved to be effective in preventing dripping; such a lip configuration does not ensure with certainty that no dripping will occur. Therefore, it has become necessary to provide a catch basin beneath the pouring lip for collecting the small amount of dripping that does occur. Such a catch basin is disclosed in U.S. Pat. No. 4,387,819, wherein it serves the dual purpose of also providing a surface on which a lid can be latched. It has also been proposed in U.S. Pat. No. 3,833,150, to provide a catch basin that drains back into the container.

SUMMARY OF THE INVENTION

It is the object of the invention to provide a dripless pouring cap having a pivottally attached closure means.

It is a further object of the invention to provide outwardly diverging pouring spout for increasing the velocity of the liquid across the pouring lip so as to acentuate the dripless feature of the lip.

It is another object of the invention to provide a dripless pouring cap wherein the pivottally attached closure assembly is isolated from first and second catch basins so that during opening and closing the closure means the user is not splashed by liquid in the basins.

The invention comprises a dripless pouring cap which may be attached to a container for providing a pouring assembly which prevents dripping of a liquid being dispensed. A closure assembly comprising a lid is pivotally connected to the cap by a hinge assembly so that the cap may be readily opened and closed. The cap comprises an outwardly diverging spout with an outwardly curved pouring rim. Two concentric catch basins are provided at the exterior base of pouring spout to catch liquid drippings not prevented by the pouring rim. The first basin is formed by an upwardly extending lip that together with the exterior wall of the pouring spout forms the basin. The second basin is formed by a channel that extends circumferentially around the first basin. Both basins are isolated from the closure means either by being remotely located from the closure means as in the first basin or located below the closure means as in the second basin. This isolation prevents splashing of liquid trapped in the basins during opening and closing of the closure means.

The outwardly diverging pouring spout provides a flow structure for the liquid being dispensed that increases the velocity of the fluid flow across the pouring rim. Increasing the velocity acentuates the drip preventing characteristics of the pouring rim.

DETAILED DESCRIPTION

Figure 1:
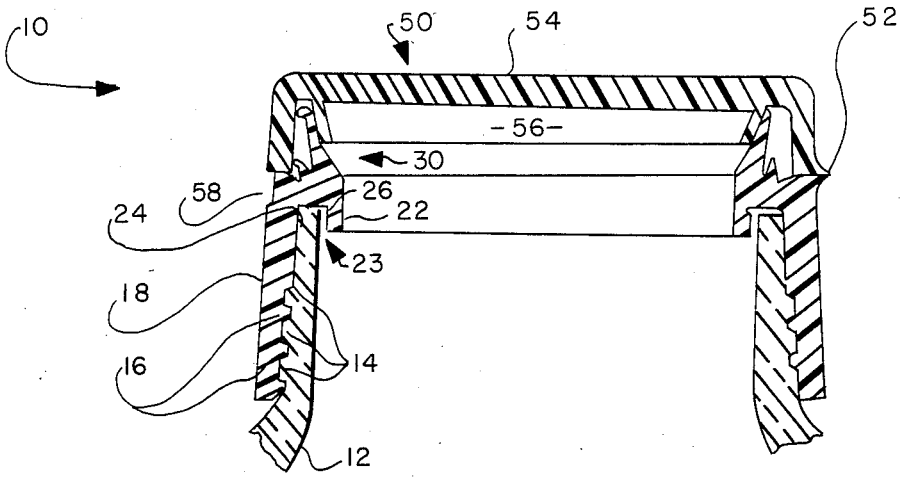
FIG. 1, is a cross section of the pouring cap and container.

FIG. 1, is a cross sectional view of pouring cap 10 which is fitted onto container 12. The container is provided with exterior threads 14 which engage interior threads 16, of exterior attachment skirt 18. The container may be made up a variety of materials but in the preferred embodiment it is made of a plastic material such as polyethylene, polypropylene or polystyrene. Skirt 18 is an element of attaching means 20 which also comprises interior skirt 22 forming channel 23 for directing liquid to the pouring spout. Both exterior and interior skirts 18 and 22 are provided with nibs 24 and 26 respectively, which are used to hold liner sealing gasket 28, which forms a seal between the cap and the container.

Figure 2:
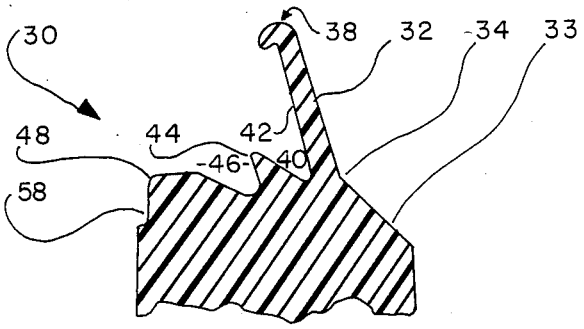
FIG. 2, is a cross section view of the pouring spout assembly.

Pouring spout 30, best illustrated in FIG. 2, is outwardly diverging, that is it is funnel-shaped. The inside of the funnel comprises two slanted sections 32 and 33 which are joined at break line 34. Spout 30 is provided with rim 36 having a dripless pouring portion 38. Pouring portion 38 is an outwardly curved portion forming a hook-shaped member.

First catch basin 40 is formed at the base of pouring spout 30 adjacent to the exterior wall 42 of the spout. The basin is created between upwardly extending lip 44 and exterior wall 42. Small droplets running down wall 42 are trapped in basin 40 preventing liquid from running down the side of the container.

Second catch basin 46 is formed around the circumference of the first basin and consists of a depression formed in horizontal surface 48 of attachment means 20. Any excess liquid spilling over the first catch basin is subsequently trapped in the second basin.

Closure means 50 is pivotally connected to attaching means 20 at 52. The closure means comprises lid 54 having an inner sealing skirt 56. As can be seen in FIG. 1, when the closure means is closed the inner skirt presses against slanted surface 32 forming a seal between the closure means and the pouring spout. Lid 54 is also provided with a downwardly extending sealing skirt enclosing the pouring spout and which engages horizontal surface 48 of the attachment means when the lid is closed.

The exterior skirt of the attaching means is provided with finger hold depression 58 for facilitating the opening of the lid by the user.

The attachment means, pouring spout and closure means are formed together during a molding operation and may comprise any number of plastics, such as polyethylene, polypropylene or polystyrene. During the molding operation a hinge means is also molded and provides a spring tension for closing the closure means.

Figure 3:
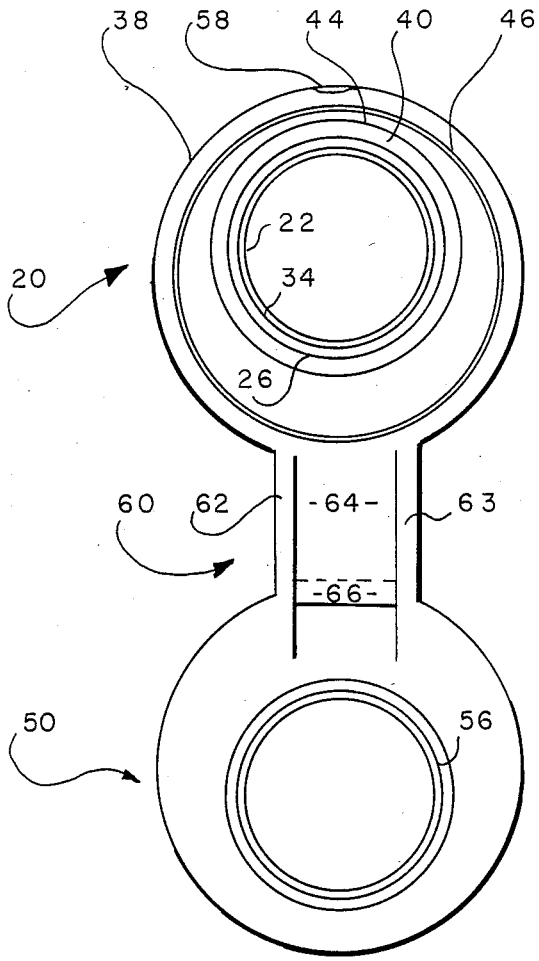
FIG. 3, is a top view of the cap and lid when the lid is opened and in an extended position.
Figure 4:
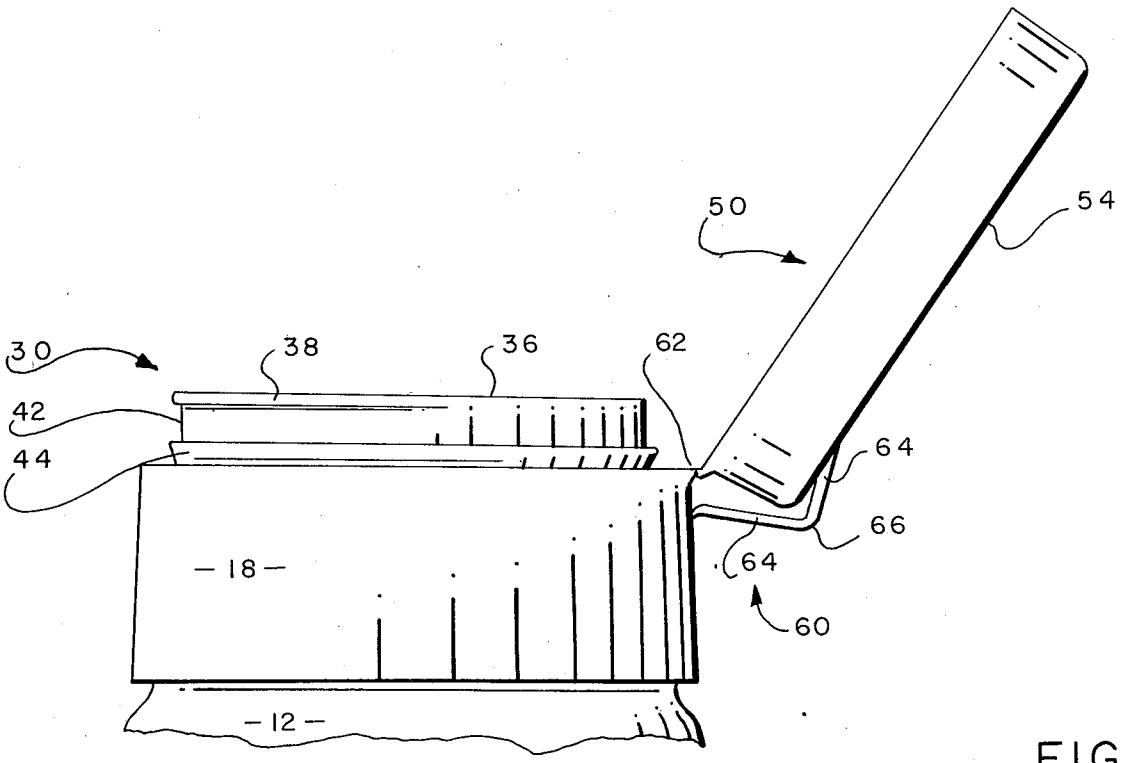
FIG. 4, is a side view of the pouring cap with the lip opened.

The structure of hinge assembly 60 is best illustrated in FIG. 3, and comprises three plastic bridges 62, 63 and 64 which connect the closure means and the attachment means. The middle bridge is provided with an L-shaped fold at 66 which is best illustrated in FIG. 4, and which provides spring tension for closing the closure means. The spring tension is created by the plastic "memory" of the middle bridge caused during the molding process. The spring tension of bridge 64 also holds the closure means in the open position illustrated in FIG. 4, so that a user does not have hold the closure open during dispensing. Bridges 62 and 63 are provided with folds at 67 and 68 to facilitate the pivotal action of the hinge.

The pouring cap is not limited to any specific hinge structure, however the above described hinge assembly is preferred because it can be formed during the molding process together with rest of the cap.

FIG. 3 also illustrates the relationship of the pouring rim, first catch basin and second catch basin to the pouring spout. More specifically, the pouring rim comprises only a portion of rim 36 which is opposite hinge assembly 60. First catch basin 40 extends completely around the base of the pouring spout immediately below rim 36. Likewise the second catch basin 46 is located outside of the first catch basin and extends completely around the pouring spout.

The above described and illustrated embodiment is given by way of example, and should not be construed as limiting the invention since the invention may be modified without departing from the spirit and scope of the invention as set forth in the claims that follow.

We claim that:

1. A dripless pouring cap for dispensing liquids from a container, comprising:

attaching means for sealingly coupling said dripless pouring cap to a container; said attaching means is provided with a horizontal surface;

an outwardly diverging pouring spout extending upwardly from a base coupled to said attaching means having interior and exterior walls, said pouring spout is provided with a rim having a drip preventing pouring portion that projects outwardly from said pouring spout and over which liquid is poured during dispensing, a first drip catching basin is formed at the base of the exterior wall of said pouring spout directly beneath the drip preventing pouring portion; and a closure means for sealing said pouring spout, said closure means is pivotally coupled to said attaching means by a hinge means and is provided with an inwardly converging interior skirt that makes sealing contact with the outwardly diverging interior wall of said pouring spout.

2. A dripless pouring cap as defined by claim 1 further comprising a second drip catching basin formed in the horizontal surface on said attaching means.

3. A dripless pouring cap as defined by claim 2 wherein said first drip catching basin is formed by an upwardly extending lip and the exterior wall of said pouring spout.

4. A dripless pouring cap as defined by claim 3 wherein said second catch basin is formed by a channel formed in the horizontal surface of said attaching means.

5. A dripless pouring cap as defined by claim 4 wherein said first and second catch basins are concentrical arranged about said pouring spout with said first basin arranged adjacent the base of said pouring spout and said second basin is arranged outside said first basin.

6. A dripless pouring cap as defined by claim 5 wherein said closure means is provided with an exterior skirt that encloses said pouring spout.

7. A dripless pouring cap as defined by claim 6 wherein the exterior skirt of said closure means rests on the horizontal surface of said attaching means when said closure means is closed.

8. A dripless pouring cap as defined by claim 7 wherein said first catch basin is remotely located from said closure means and said second catch basin is located below said closure me to isolate said first and second basins from said closure means to prevent splashing of liquid trapped in said catch basins during opening and closing of said closure means.

9. A dripless pouring cap as defined by claim 8 wherein said attaching means is provided with a cylindrical outer skirt which is threaded so that said pouring cap can be screwed onto a container.

10. A dripless pouring cap as defined by claim 9 wherein said attaching means is provided with a cylindrical inner skirt which provides a cylindrical channel for directing liquid from container into said pouring spout.

11. A dripless pouring cap as defined by claim 10 wherein a liner gasket is positioned in an annular space formed between the inner and outer skirts of said attaching means to form a seal between said pouring cap on which said cap is mounted.

12. A dripless pouring cap as defined by claim 11 wherein the cylindrical outer skirt of said attaching means is internally threaded so that it may be screwed onto externally threaded containers.

13. A dripless pouring cap as defined by claim 12 wherein the hinge means of said closure means is spring tensioned to hold the closure means in a closed position.

14. A dripless pouring cap as devined by claim 13 wherein said pouring cap is formed of molded plastic.

15. A dripless pouring container for dispensing liquids, comprising:

a container for holding liquids, a funnel-shaped pouring spout attached to said container extending upwardly from said container and having exterior and interior walls, the pouring spout is provided with a rim having a drip preventing pouring portion that projects outwardly from said pouring spout and over which liquid is poured during dispensing;

a first drip catching basin formed at the base of the exterior wall of said pouring spout directly beneath the drip preventing pouring portion; and a closure means for sealing and enclosing said pouring spout and said closure means is pivotally coupled to said container by a hinge means.

16. A dripless pouring container as defined by claim 15 wherein said container is provided with a horizontal surface on which a second drip catching basin is formed.

17. A dripless pouring container as defined by claim 16 wherein said first and second catch basins are concentrically arranged about said pouring spout wherein said first basin is positioned adjacent the base of said pouring spout and said second basin is positioned outside said first basin.

18. A dripless pouring container as defined by claim 17 wherein said first catch basin is remotely located from said closure means and said second catch basin is located below said closure means to isolate said first and second basins from said catch basins during opening and closing of the closure means.

19. A dripless pouring container as defined by claim 18 wherein the hinge means of said closure means is spring tensioned to hold the closure means in a closed position.

* * * * *